US009386853B2

(12) United States Patent
Susnjara

(10) Patent No.: US 9,386,853 B2
(45) Date of Patent: Jul. 12, 2016

(54) CABINET DRAWER STOP MECHANISM

(75) Inventor: Kenneth J. Susnjara, Birdseye, IN (US)

(73) Assignee: Thermwood Corporation, Dale, IN (US)

( * ) Notice: Subject to any disclaimer, the term of this patent is extended or adjusted under 35 U.S.C. 154(b) by 0 days.

(21) Appl. No.: 13/338,882

(22) Filed: Dec. 28, 2011

(65) Prior Publication Data

US 2013/0169137 A1 Jul. 4, 2013

(51) Int. Cl.

| | |
|---|---|
| ***A47B 95/00*** | (2006.01) |
| ***A47B 88/16*** | (2006.01) |
| *A47B 88/04* | (2006.01) |

(52) U.S. Cl.

CPC ..... *A47B 88/16* (2013.01); *A47B 88/047* (2013.01); *Y10T 16/61* (2015.01)

(58) Field of Classification Search

CPC ..... A47B 88/047; Y10T 292/65; E05C 3/14; E05C 3/145; E05C 3/041

USPC ..... 312/334.7–334.13, 334.44–334.47; 16/35 R; 144/347

See application file for complete search history.

(56) References Cited

U.S. PATENT DOCUMENTS

| | | | | | |
|---|---|---|---|---|---|
| 107,762 | A * | 9/1870 | Coughlin | 188/4 R | |
| 199,825 | A * | 1/1878 | Harris | 312/334.19 | |
| 321,078 | A * | 6/1885 | Birckhead | 312/298 | |
| 526,014 | A * | 9/1894 | Hunter | 220/550 | |
| 822,123 | A * | 5/1906 | Herzog | 312/323 | |
| 1,391,896 | A * | 9/1921 | Hiserodt | 16/82 | |
| 1,421,563 | A * | 7/1922 | Raggio | 312/217 | |
| 3,358,792 | A * | 12/1967 | Proulx | 188/29 | |
| 3,889,992 | A * | 6/1975 | Shelton | 292/87 | |
| 4,805,970 | A * | 2/1989 | Scalf | 312/334.47 | |
| 5,052,878 | A * | 10/1991 | Brockhaus | 414/522 | |
| 5,738,397 | A * | 4/1998 | Grody | E05C 19/18 292/258 | |
| 6,056,378 | A * | 5/2000 | Semon et al. | 312/246 | |
| 6,120,072 | A * | 9/2000 | Benedict | 292/338 | |
| 7,331,617 | B2 * | 2/2008 | Johnson | E05B 17/2019 16/82 | |

* cited by examiner

*Primary Examiner* — Daniel J Troy
*Assistant Examiner* — Andres Gallego
(74) *Attorney, Agent, or Firm* — Bookoff McAndrews, PLLC

(57) ABSTRACT

A stop mechanism for a drawer displaceable along a line of travel into and out of a compartment of a cabinet, such drawer including a first surface disposed parallel to the line of travel and a second surface disposed at an angle relative to such line of travel, having a member pivotally mountable on such structure, displaceable between a first position resting upon such first drawer surface, in abutting alignment with the second drawer surface, obstructing removal of such drawer from the opening along such line of travel, and a second position out of resting relation with such first drawer surface and abutting alignment with such second drawer surface, permitting the removal of such drawer from such compartment along such line of travel.

17 Claims, 3 Drawing Sheets

CABINET DRAWER STOP MECHANISM

This invention relates to a stop for a drawer of a structure such as cabinet, dresser, desk and the like, and more particularly to such a stop which is effective in preventing such a drawer from being unintentionally fully removed from a compartment of such a structure but which may be easily manually manipulated when required to permit such fall removal therefrom. This invention further relates to a structure provided with at least one drawer utilizing such a stop, and a method of the components of such a structure.

BACKGROUND OF THE INVENTION

Furniture pieces such as cabinets, dressers, desks and the like typically include a housing providing one or more compartments accommodating one or more drawers which can be installed, opened and closed and fully removed. Generally, such drawers are provided with cooperating guides and bearings in the sidewalls of the drawers and opposed walls of such pieces which function to permit such drawers to be rolled open and closed. Often, such cooperating guide and bearing devices are provided with stop members which prevent such drawers running freely outwardly and separating from the housing structure. Alternatively, such drawers may be provided with projecting portions engageable with components of the housing structure which prevent the removal of the drawers along guided lines of travel of the drawers. Drawers with such forms of stops generally require a tilting of a drawer from its normal line of travel to overcome an obstructing member of the support piece in order to free the drawer for removal. Such tilting requirement has several disadvantages including having to perhaps provide a larger opening of the drawer's compartment to permit the tilting of the drawer in surmounting the stop device, and having to lift and maneuver the drawer out of the drawer compartment.

Accordingly, it the principal object of the present invention to provide a stop for a drawer provided in a housing structure in which such stop may be oriented in a first position to permit the drawer to be readily opened and closed without the risk of unintended removal, and in a second position to permit the drawer to be easily removed by simply drawing the drawer outwardly along its normal line of travel.

Another object of the invention is to provide a structure utilizing such a stop.

A still further object of the invention is to provide a method of fabricating the components of a structure utilizing such a stop.

SUMMARY OF THE INVENTION

The principal object of the present invention is achieved by providing a stop mechanism for a drawer displaceable along a line of travel into out of a compartment of a structure, such drawer including a first surface disposed parallel to such line of travel and a second surface at an angle relative to such line of travel, comprising a member pivotally mountable on such structure, movable between a first position in resting relation upon such first drawer surface, in abutting alignment with such second drawer surface, obstructing removal of such drawer from such compartment along such line of travel, and a second position out of resting relation with such first drawer surface and out of abutting alignment with such second drawer surface, permitting removal of such drawer from such compartment along such line of travel. In the preferred embodiment of the invention, such first surface comprises a top surface of a side panel of a drawer, such second surface comprises a front face of a rear panel of such drawer, and the stop mechanism is pivotally connected to a pin mounted on a side panel of the structure in which the drawer is situated, and has a U-shaped cross-sectional configuration including a web segment pivotal into and out of engagement with the top surface of the side panel of the drawer, and a set of leg segments, one of which is pivotal into and out of abutting alignment with the front face of the rear panel of such drawer.

Another object of the invention is achieved by forming the structure panels, the drawer panels, the track receiving slots in the structure side panels and the cooperating drawer panels and the holes for supporting dowel pins pivotally supporting such stops, from sheets of material by means of a suitably programmed CNC router, assuring proper sizing of the structure and drawer panels, minimal drawer compartments in the finished structure and accurate positioning of structure and drawer slots and the holes of the dowel pins of the stops, to permit an experienced assembler or a lay person to accurately and readily assemble such a structure.

DETAILED DESCRIPTION OF THE PREFERRED EMBODIMENTS OF THE INVENTION

Figure 1:
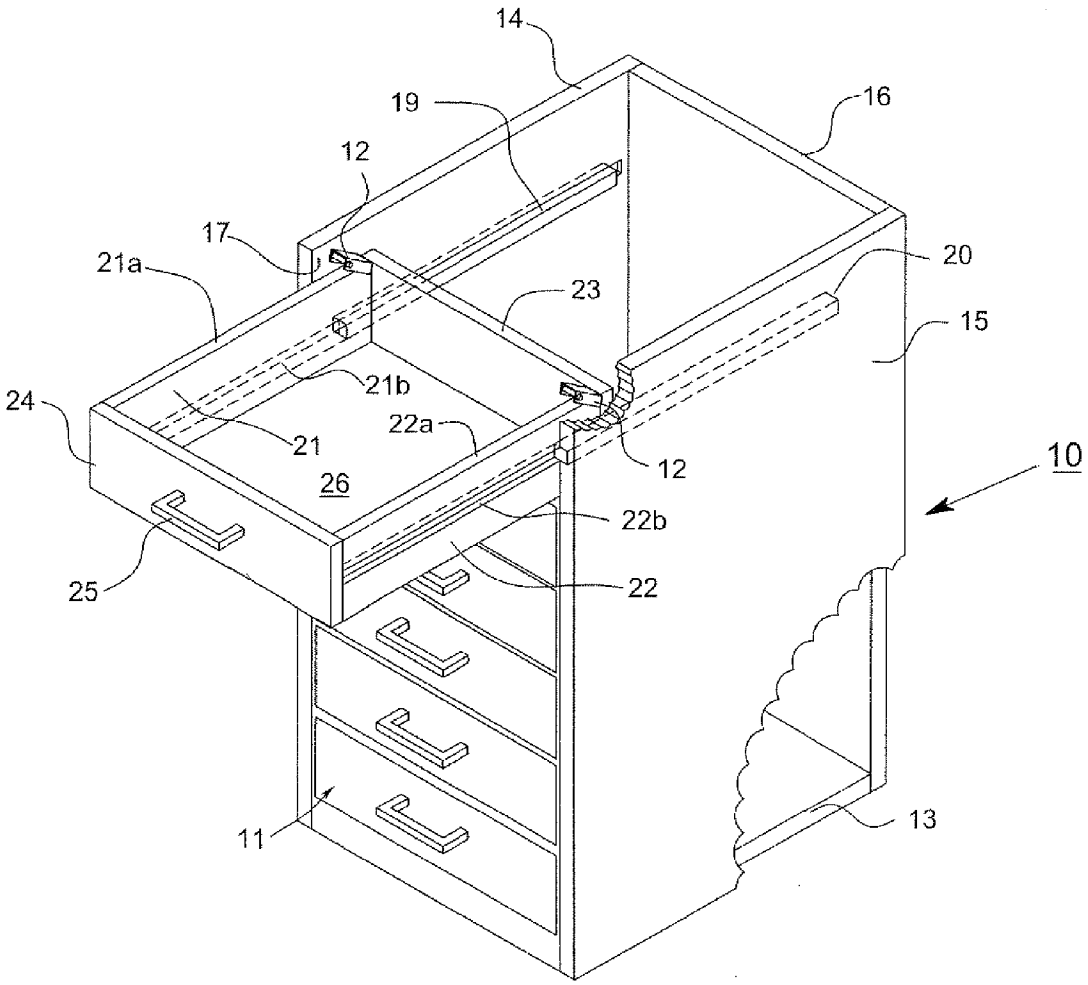
FIG. 1 is a perspective view of a cabinet provided with a set of drawers in which one of the drawers is shown withdrawn from a compartment of such cabinet and in which portions of such cabinet are removed to more clearly disclose the stop mechanism embodying an aspect of the present invention in relation to such drawer.

Referring to the drawings, there is illustrated a cabinet 10 provided with a number of compartments in which a set of drawers 11 is disposed, each provided with a set of stop mechanisms 12. Cabinet 10 is of a convention construction including a base member 13, a pair of side panels 14 and 15, a rear panel 16 and a top panel (not shown) providing a front drawer-receiving opening 17 in which there is a received the set of drawers. The inner surfaces of cabinet panels 14 and 15 are provided with sets of vertically spaced, opposed milled grooves 19 and 20 provided with a set of guide members for supporting and permitting a drawer to slide into and out of a compartment of the cabinet.

Each drawer is provided with a pair of side walls 21 and 22 having the same height and length, upper elongated surfaces 21*a* and 22*a* and milled grooves 21*b* and 22*b* in the outer surfaces thereof which cooperate with the guide members in milled grooves 19 and 20 for guiding the drawer into and out of a cabinet compartment, a rear panel 23 having the same height as side panels 21 and 22 and abutting the reared ends thereof, a front panel 24 provided with a handle 25 and a bottom panel 26.

Figure 3:
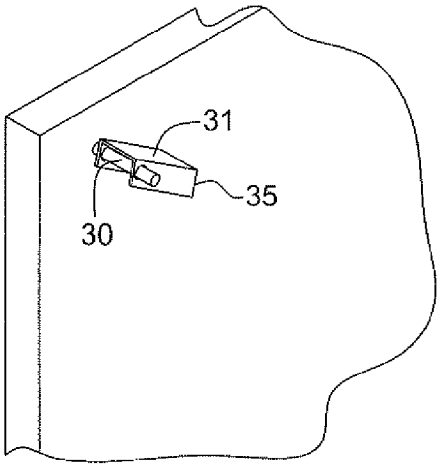
FIG. 3 is an enlarged partial perspective view of a side panel of the cabinet shown FIG. 1, illustrating the mounting of the stop mechanism on the cabinet.
Figure 2:
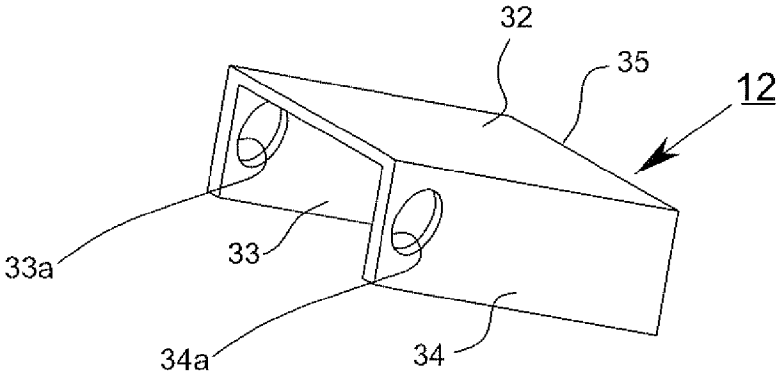
FIG. 2 is an enlarged, perspective view of a component of the stop mechanism shown in FIG. 1.
Figure 5:
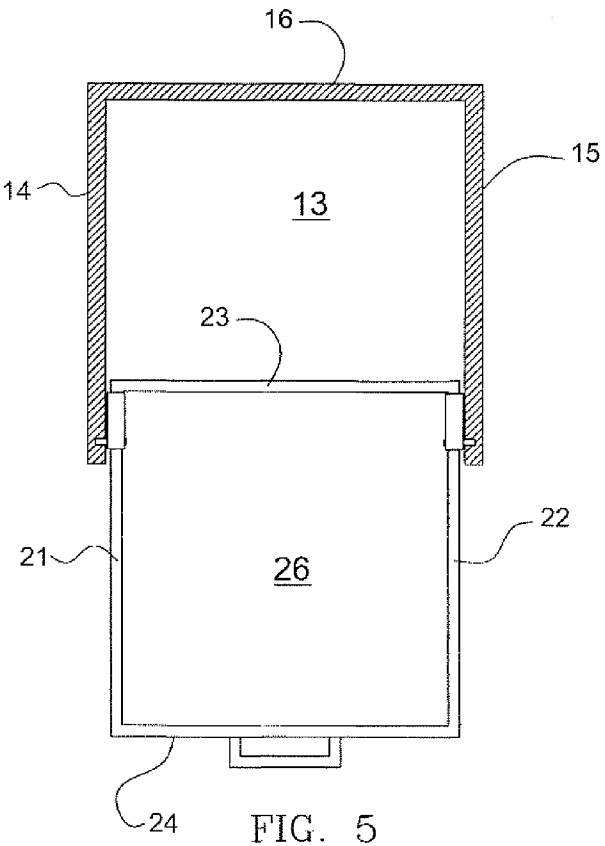
FIG. 5 is a view similar to the view shown in FIG. 4, illustrating the drawer in a fully opened position, postured to have the stop mechanisms thereof manipulated to free the drawer from the cabinet and permit it to be removed entirely from the cabinet.
Figure 4:
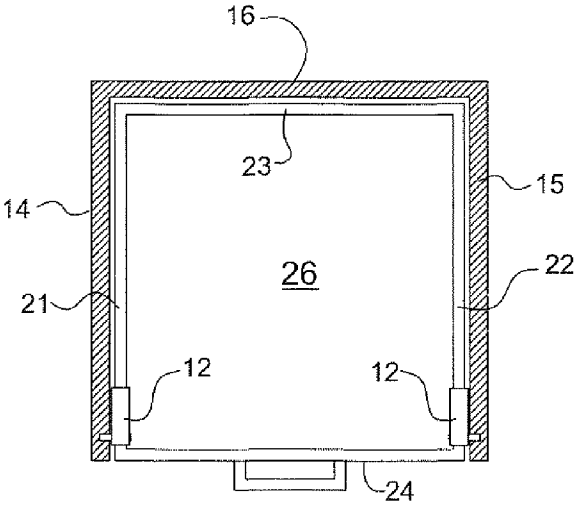
FIG. 4 is a top plan view of the cabinet shown in FIG. 1, having the top panel removed, illustrating the top drawer of such a cabinet in a fully closed position.
Figure 6:
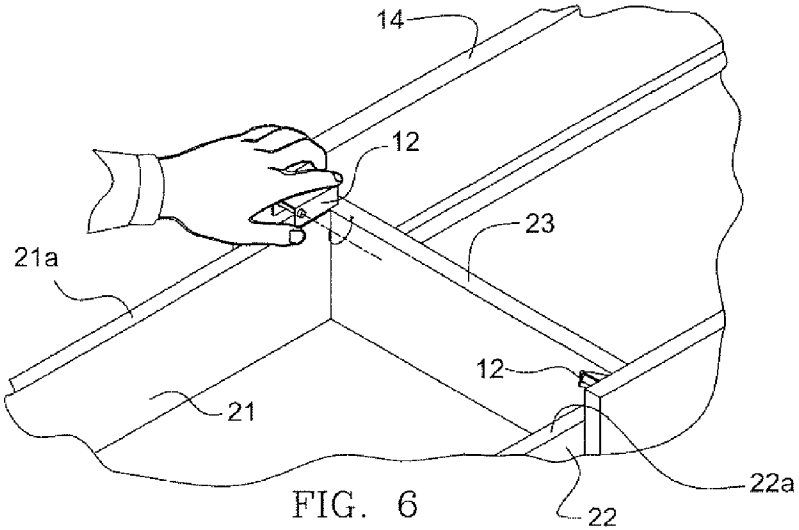
FIG. 6 is an enlarged, partial perspective view of the cabinet and drawer shown in FIG. 5 illustrating the manner in which one of the stop mechanisms may be manually manipulated to free the drawer for removal from the cabinet.

Referring to FIGS. 2 and 3, each stop mechanism 12 includes a dowel pin 30 and a member 31 pivotally mounted on such dowel pin. Each dowel pin 30 is mounted on an inner side of a panel of the cabinet. Such pins are mounted at heights above the upper edges 21*a* and 22*a* of a drawer and adjacent the front ends of cabinet side panels 14 and 15. Each member 31 is provided with a U-shaped cross-sectional configuration and includes a web segment 32 and a pair of leg segments 33 and 34. The leg segments further are provided with a pair of transversely aligned openings 33*a* and 34*a* which are adapted to receive a dowel pin 30 to permit the member to pivot about the axis of such pin. The spacing between leg segments 33 and 34 of each of such members is slightly greater than the thickness of a side panel of a drawer, the support pin thereof is spaced sufficiently above the upper surfaces 21*a* and 22*a* of an associated drawer and the length of the member is sufficient so that upon installation of a drawer 18 into a cabinet compartment and the mounting of the stop members as described, each of the stop members is caused to be disposed in a lower position as shown in FIGS. 1, 4 and 5, receiving the upper end of a side panel 21 or 22 between the leg segments thereof, permitting the drawer to be freely slid into and out of its cabinet compartment. With the stop members in such positions, the drawer would be prevented from being entirely removed from its cabinet compartment by the engagement of the edge of the inner leg segment of each stop member engaging the front surface of rear panel 23, as shown in FIGS. 1 and 5. However, with the drawer in an extended position as shown in FIGS. 1, 5 and 6, the drawer may be entirely removed simply by manually pivoting each of the stop members upwardly to a second position clear of the upper edge of the rear panel, as shown in FIG. 6, and continuing to withdraw the drawer from the cabinet compartment. To reinstall the drawer into the cabinet compartment, the procedure as described is reversed in which the stop members manually are pivoted upwardly to their second positions, the drawer is aligned with the cabinet compartment, the aligned drawer is inserted into the compartment and the stop members are permitted to pivot downwardly onto the side panels of the drawer upon clearance of the rear panel past the stop members.

In the embodiment as described, the side panels of the drawer are adapted to ride within the leg segments of the stop members as the drawer is opened and closed, and the front edges of the inner leg segments of the stop members are adapted to engage portions of the front face of the rear drawer panel to prevent the drawer from being fully removed from the cabinet compartment. In alternate embodiments of the invention, the abutment surface of the stop member may consist of a surface of a side panel of the drawer projecting slightly above the plane of side panel upper surfaces 21*a* and 22*a* or a surface of the rear panel of the drawer disposed slightly above the plane of upper surface 21*a* and 22*a*, where the lateral ends of the rear panel engage the rear ends of the side panels. In each of such alternate embodiments, the drawer would be prevented from being fully removed from the compartment thereof by the engagement of the leading edge 35 of a stop member with either the abutment surface of an upwardly projecting rear end portion of a drawer side wall or the abutment surface of a rear drawer panel secured to the rear ends of the side panels and projecting short distances above the plane of upper edges 21*a* and 22*a* of the side panels.

In each of the embodiments as described, with each of the stop members in its lower position and the web segment thereof resting on an upper edge of a side panel, the drawer may be easily moved outwardly and inwardly relative to its cabinet compartment, and the drawer would be prevented from being removed entirely from the compartment by the stop mechanisms unless the mechanisms are manipulated to their upper, nonabutment aligned positions, allowing the drawer to be fully removed from the cabinet compartment. No tilting or other maneuvering of the drawer is required for the complete removal of the drawer as in prior art arrangements. No or minimal modification of the drawers is required and the cost of forming and mounting the stop mechanisms is deemed to be minimum.

The cabinet panels and the drawer components are intended to be formed from sheets of wooden material of suitable thickness, utilizing a suitably programmed CNC router. Such sheets are intended to be loaded onto the worktable of such machine, and the machine is operated to cut, mill and drill the various several components. The program executed by the machine is functional to nest the various components in maximizing the yield of components from a sheet of material, mill the slots in the side walls of the cabinet and drawer panels and drill the holes for the dowel pins in the side walls of the cabinet side walls. The program assures that cabinet panels are suitably sized to provide suitable drawer compartments, the slots accommodating the drawer slides are suitably positioned to register in alignment, and the dowel pin holes are suitably positioned relative to the side walls of the drawer to properly position the stops relative to such drawer side walls. Such preparation of the cabinet and drawer panels allows either a journeyman or lay person to easily and accurately assemble such components. Such means of production of the components further permits the preparation of panels for cabinets of different sizes and different numbers and sizes of drawers, and the sale of such components for assembly by lay persons of limited fabrication skills.

From the foregoing detailed description, it will be evident that there are a number of changes, adaptations and modifications of the present invention, which come within the province of those persons having ordinary skill in the art to which the aforementioned invention pertains. However, it is intended that all such variations not departing from the spirit of the invention be considered as within the scope thereof as limited solely by the appended claims.

I claim:

1. A cabinet assembly, comprising:

a structure having a first wall and a second wall positioned opposite the first wall so that a surface of the first wall faces a surface of the second wall;

a first guide rail located on the surface of the first wall, and a second guide rail located on the surface of the second wall;

a compartment having a first side wall and a second side wall positioned parallel to and opposite from the first side wall, and an end wall positioned perpendicular to the first side wall and the second side wall and extending from an end portion of the first side wall to an end portion of the second side wall, wherein an outer surface of the first side wall is configured to slidingly engage the first rail and an outer surface of the second side wall is configured to slidingly engage the second rail; and a stop mechanism mounted on the first wall, wherein the stop mechanism comprises:

an elongate member projecting out from the surface of the first wall; and a U-shaped member having an upper surface, a first side leg extending down from a first end of the upper surface, and a second side leg extending down from a second end of the upper surface, wherein the first side leg and the second side leg are parallel to one another, and wherein the first side leg and the second side leg each have an opening located at a front region of the U-shaped member such that the elongate member projects through both the opening of the first side leg and the opening of the second side leg;

wherein the U-shaped member is pivotably coupled to the elongate member;

wherein the first side leg of the U-shaped member extends down over a portion of the outer surface of the first side wall of the compartment, and the second side leg of the U-shaped member extends down over a portion of an inner surface of the first side wall of the compartment;

wherein an edge of the upper surface of the U-shaped member contacts at least one of an upper edge portion of the first side wall of the compartment or an upper edge portion of the end wall of the compartment when the U-shaped member is in a first position; and wherein the edge of the upper surface of the U-shaped member does not contact the upper edge portion of the first side wall of the compartment or the upper edge portion of the end wall of the compartment when the U-shaped member is in a second position.

2. The cabinet assembly of claim 1, wherein the first guide rail and the second guide rail are parallel to one another and extend in a horizontal direction.

3. The cabinet assembly of claim 2, wherein the compartment is configured to slide along the first guide rail and the second guide rail in the horizontal direction.

4. The cabinet assembly of claim 3, wherein, when the U-shaped member contacts the upper edge portion of the end wall of the compartment in the first position, the compartment is maintained in the horizontal direction, parallel to the first guide rail and the second guide rail.

5. The cabinet assembly of claim 4, wherein, when the U-shaped member does not contact the upper edge portion of the end wall of the compartment in the second position, the compartment is removable from the cabinet assembly.

6. The cabinet assembly of claim 1, further comprising a second stop mechanism mounted on the second wall;

wherein a first side leg of a U-shaped member of the second stop mechanism extends down over a portion of the outer surface of the second side wall of the compartment, and a second side leg of the U-shaped member of the second stop mechanism extends down over a portion of an inner surface of the second side wall of the compartment;

wherein an edge of the upper surface of the U-shaped member of the second stop mechanism contacts at least one of an upper edge portion of the second side wall of the compartment or the upper edge portion of the end wall of the compartment when the U-shaped member of the second stop mechanism is in a first position; and wherein the edge of the upper surface of the U-shaped member of the second stop mechanism does not contact the upper edge portion of the second side wall of the compartment or the upper edge portion of the end wall of the compartment when the U-shaped member of the second stop mechanism is in the second position.

7. The cabinet assembly of claim 1, wherein the compartment is configured to be removably received within the cabinet assembly.

8. The cabinet assembly of claim 1, wherein the compartment is a drawer.

9. The cabinet assembly of claim 1, wherein the stop mechanism is mounted on the first wall at a location above the first guide rail.

10. The cabinet assembly of claim 1, wherein the first side leg of the U-shaped member extends down from an entire length of the first end of the upper surface, and the second side leg of the U-shaped member extends down from an entire length of the second end of the upper surface.

11. The cabinet assembly of claim 1, further comprising:

a plurality of stop mechanisms mounted on at least one of the first wall and the second wall; and a plurality of guide rails mounted on each of the first wall and the second wall, wherein the cabinet assembly is configured to receive a plurality of compartments.

12. An enclosure for receiving a drawer, comprising:

a structure having a first wall and a second wall positioned opposite the first wall so that a surface of the first wall faces a surface of the second wall, wherein the first wall and the second wall define a space between them configured to receive the drawer;

a first guide rail located on the surface of the first wall and a second guide rail located on the surface of the second wall, wherein the first guide rail and the second guide rail are configured to receive the drawer; and a stop mechanism mounted on the first wall, wherein the stop mechanism comprises:

an elongate member projecting out from the surface of the first wall; and a U-shaped member having an upper surface, a first side leg extending down from a first end of the upper surface, and a second side leg extending down from a second end of the upper surface, wherein the first side leg and the second side leg are parallel to one another, and wherein the first side leg, the upper surface, and the second side leg cooperatively define three sides of a rectangle and an open region between the three sides that is configured to receive an upper edge of a side wall of the drawer when the drawer is received within the enclosure;

wherein the first side leg and the second side leg each have an opening located at a front region of the U-shaped member such that the elongate member projects through both the opening of the first side leg and the opening of the second side leg; and wherein the U-shaped member is pivotable around the elongate member so that a leading edge of the upper surface of the U-shaped member is deflected downward in a first position, and wherein the leading edge of the upper surface of the U-shaped member is pivoted upwards in a second position; and wherein the enclosure further comprises: a drawer received in the space between the first wall and the second wall of the structure; wherein the drawer includes a first side wall and a second side wall positioned parallel to and opposite from the first side wall, and an end wall positioned perpendicular to the first side wall and the second side wall and extending from an end of the first side wall to an end of the second side wall; wherein an outer surface of the first side wall is configured to slidingly engage the first rail and an outer surface of the second side wall is configured to slidingly engage the second rail; and wherein the first side leg of the U-shaped member extends down over a portion of the outer surface of the first side wall of the drawer, and the second side leg of the U-shaped member extends down over a portion of an inner surface of the first side wall of the drawer; wherein the leading edge of the upper surface of the U-shaped member contacts at least one of an upper edge of the first side wall of the drawer or an upper edge of the end wall of the drawer when the U-shaped member is in the first position; and wherein the leading edge of the upper surface of the U-shaped member does not contact the upper edge of the first side wall of the drawer or the upper edge of the end wall of the drawer when in the second position, allowing the drawer to be removed from the enclosure when the stop mechanism is in the second position.

13. The enclosure of claim 12, further comprising a second stop mechanism mounted on the second wall.

14. The enclosure of claim 12, wherein the first guide rail and the second guide rail are parallel to one another and extend in a horizontal direction.

15. The enclosure of claim 12, wherein the stop mechanism is mounted on the first wall at a location above the first guide rail.

16. The enclosure of claim 12, wherein the first side leg of the U-shaped member extends down from an entire length of the first end of the upper surface, and the second side leg of the U-shaped member extends down from an entire length of the second end of the upper surface.

17. The enclosure of claim 12, further comprising a plurality of stop mechanisms mounted on the first wall and a plurality of stop mechanisms mounted on the second wall, wherein the enclosure is configured to receive a plurality of drawers.

* * * * *